US005140637A

United States Patent [19]

McCarthy

[11] Patent Number: 5,140,637

[45] Date of Patent: Aug. 18, 1992

[54] DEVICE AND METHOD FOR REMOVING VOCAL SIGNALS

[75] Inventor: Timothy McCarthy, North Valley Stream, N.Y.

[73] Assignees: Arnold Kaplan, New York; Mark Polyocan, Great Neck; Arthur J. Williams, New York, all of N.Y.

[21] Appl. No.: 701,782

[22] Filed: May 17, 1991

Related U.S. Application Data

[63] Continuation of Ser. No. 444,228, Dec. 1, 1989, abandoned.

[51] Int. Cl.[5] ..... H04S 1/00

[52] U.S. Cl. ..... 381/1

[58] Field of Search ..... 381/1, 28

[56] References Cited

U.S. PATENT DOCUMENTS 4,803,728 2/1989 Lueken ..... 381/25

*Primary Examiner*—Forester W. Isen

*Attorney, Agent, or Firm*—Alan H. Levine

[57] ABSTRACT

A vocal signal removing device includes a member for connecting one of the left or right side positive output terminals of a stereophonic sound reproducing device, e.g., tape, compact disk, or phonograph player, to the corresponding left or right side positive input terminal of an amplifier, and a member for connecting the other positive output terminal of the reproducing device to the negative input terminal of the amplifier on the side opposite the side to which the one positive input terminal is connected. A switch may be provided for effecting alternative connections to provide full stereo sound or monophonic sound including the vocal signal.

10 Claims, 1 Drawing Sheet

DEVICE AND METHOD FOR REMOVING VOCAL SIGNALS

This application is a continuation of application Ser. No. 444,228, filed Dec. 1, 1989, now abandoned.

This invention relates to music reproduction, such as by means of a phonograph, tape player, or compact disk player, and more particularly to stereophonically recorded sound comprising both vocal and instrumental music.

Some users of stereophonic sound reproduction equipment find it desirable to delete the vocal component of prerecorded music so that only the instrumental component can be heard. This allows a user to sing and be accompanied by the instrumental music without interference from the prerecorded vocal. If the user adds a microphone, his own singing voice can be heard through the speaker system of the stereo arrangement along with the instrumental component of the prerecorded music. Additionally, the user's singing voice and the instrumental component of the music can be introduced into a tape recorder to produce a tape recording containing the user's singing voice accompanied by the prerecorded instrumental component of the original recording.

A vocal signal removing device is illustrated and described in Japanese published Patent Application No. 61-193336, filed Aug. 19, 1986, and published Mar. 3, 1988. The Japanese patent application describes, with reference to FIG. 2 thereof, a device in which the left and right stereo signals are applied to both an adder and a subtracter. Both the adder and subtracter perform analog calculations so that the output of the adder is a monaural signal containing both the vocal and instrumental music, and the output of the subtracter is a music signal with the vocal component removed. A switch is provided so that the output of either the adder or subtracter may be selected. A microphone and control circuit are also provided so that when the user sings with the microphone, the control circuit automatically operates the switch to select the output from the subtracter.

U.S. Pat. No. 3,941,931 refers to a method which has been proposed wherein the center vocal signal, or monaural signal, contained in stereophonic signals is eliminated and a signal from a microphone is added to the stereophonic signals. With this method, the sound from the user and from the recording is reproduced by the same speaker, and the singer's voice on the recording is entirely eliminated. This U.S. patent goes on to describe a complicated arrangement for mixing sound so that the monaural signal from the recording is reproduced from one speaker and additional sound from a microphone is reproduced by the other speaker.

Japanese published Patent Application No. 59-25831, filed Feb. 13, 1984, and published Sep. 2, 1985 discloses a complex system wherein left and right channel voice signals are added in opposite phases so as to cancel them out in response to input music from a microphone.

Japanese published Patent Application No. 58-78822, filed May 4, 1983, and published Nov. 19, 1984 also shows a complicated arrangement in which left and right channel signals are collected at the same time from a sound source and localized at the center. The analog signals are converted to digital signals, analyzed, converted back to analog signals, and respective sound source signals are separated and extracted from the input sound signals.

It is an object of the present invention to provide a very simple device and method for removing the vocal signal component from a stereophonic recording containing both vocal and instrumental music.

According to the invention, elimination of the vocal signal is achieved without resort to complicated adder or subtracter circuits. Instead, the result is accomplished simply by interconnecting the output terminals of a sound reproducer to the input terminals of an amplifier in a particular way, without the intervention of any additional circuitry.

It is another object of the invention to provide a vocal signal removing device incorporating a switch to permit selection of any one of vocal elimination, full stereo, or monaural vocal and instrumental.

Additional objects and features of the invention will be apparent from the following description, in which reference is made to the accompanying drawings.

Figure 1:
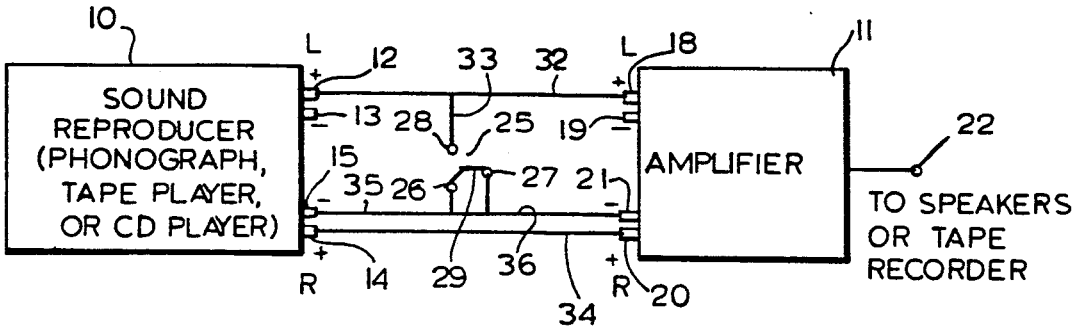
FIG. 1 is a schematic illustration of the invention switched to provide full stereophonic sound.

The arrangement chosen to illustrate the present invention is shown in FIG. 1 associated with a conventional stereophonic sound reproducing device 10, which may be a phonograph, a tape player, or a compact disk player, and an amplifier 11. It is assumed that the device 10 is furnished with a record, tape, or compact disk carrying a selection including both vocal and instrumental music.

Sound reproducing device 10 has the usual standard coaxial output receptacles presenting a left side positive terminal 12, a left side negative terminal 13, a right side positive terminal 14, and a right side negative terminal 15. For convenience, the terminals on each side are shown next to each other, although in reality they are arranged coaxially with one surrounding the other.

Amplifier 11 is also conventional, and has the usual standard coaxial input receptacles presenting a left side positive terminal 18, a left side negative terminal 19, a right side positive terminal 20, and a right side negative terminal 21. The output 22 of the amplifier may be connected to speakers or to a tape recorder.

Figure 2:
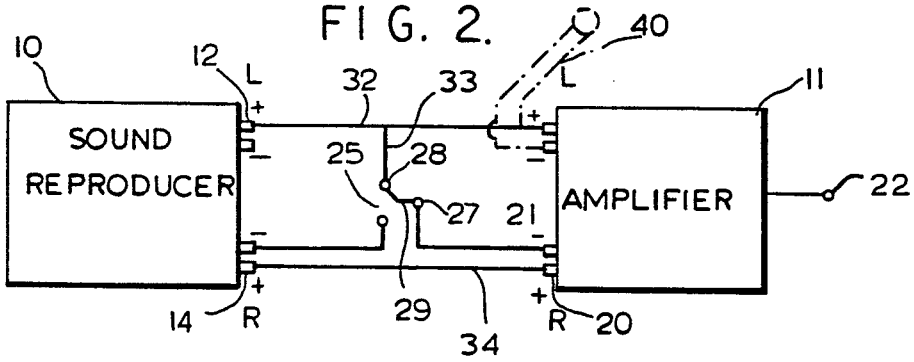
FIG. 2 is a view similar to FIG. 1, but switched to eliminate the vocal component of the music.
Figure 3:
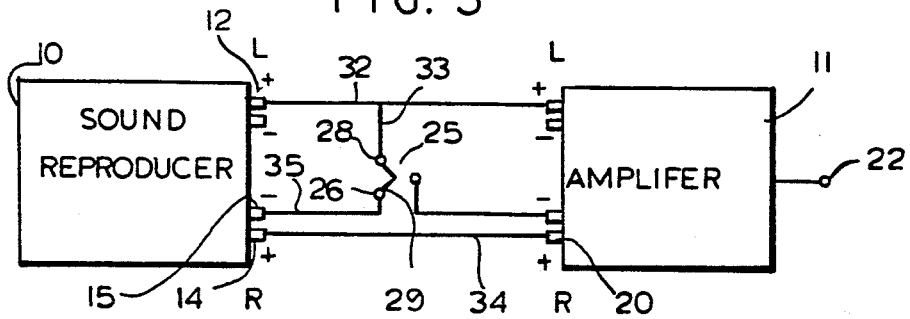
FIG. 3 is a view similar to FIG. 1, but switched to provide monaural music including both the vocal and instrumental components.

The device of the invention may be composed of conventional wires and connectors of the type ordinarily used to interconnect the components of a stereo sound system, the connectors at the ends of the wires being of the coaxial type for cooperation with the receptacles of the sound reproducer 10 and amplifier 11 Preferably, a rotary switch 25 is provided having three stationary contacts 26, 27, and 28, and a rotatable contact 29 having three positions for interconnecting any two of the stationary contacts to each other, as desired (see FIGS. 1-3).

When the wires and connectors of the invention are connected between sound reproducer 10 and amplifier 11, they provide a connection 32 between the left side positive terminal 12 of the sound reproducer and the left side positive terminal 18 of the amplifier. A branch 33 connects connection 32 to stationary switch contact 28. Another connection 34 is established between right side positive terminal 14 of sound reproducer 10 and right side positive terminal 20 of amplifier 11. An additional connection 35 is established between right side negative terminal 15 of the sound reproducer and stationary switch contact 26, and another connection 36 joins right side negative terminal 21 of amplifier 11 and stationary switch contact 27. Left side negative terminal 13 of the sound reproducer and left side negative terminal 19 of the amplifier remain unconnected.

When switch 25 is in the position shown in FIG. 1, rotatable contact 29 interconnects stationary contacts 26 and 27. As a result, the left side positive output of sound reproducer 10 is applied to the left side positive input of amplifier 11, via connection 32, and the right side positive and negative outputs of the sound reproducer are applied to the right side positive and negative inputs of amplifier 11, via connection 34 (positive) and connection 35, switch 25, and connection 36 (negative). Consequently, full stereo sound, including vocal and instrumental music is applied to the amplifier and appears at output 22.

When switch 25 is manipulated so that rotatable contact 29 interconnects stationary contacts 27 and 28 (FIG. 2), the right positive output terminal 14 remains connected to right positive input terminal 20. However, right negative output terminal 15 is no longer connected to right negative input terminal 21. Instead, left positive output terminal 12 of sound reproducer 10 is now connected to right negative input terminal 21 of amplifier 11, via connections 32 and 33, switch 25, and connection 36. As a result, the vocal portion of the original stereo signal is cancelled, leaving a monaural instrumental music signal, without a vocal component, available at amplifier output 22.

With the sound reproducer 10 and amplifier 11 connected together as shown in FIG. 2, a microphone could be connected to the left side input of the amplifier, and the user's own voice added to the prerecorded instrumental music component at amplifier output 22. This prerecorded instrumental component and "live" singing can be applied to speakers or to a tape recorder.

According to the invention, a third position of switch 25, shown in FIG. 3 is available. In this condition, rotatable switch contact 29 interconnects stationary switch contacts 26 and 28. Here again, right positive output terminal 14 remains connected to right positive input terminal 20. However, left positive output terminal 12 is connected to left negative output terminal 15, thereby cancelling these two outputs, leaving a monaural signal including both instrumental and vocal music. In this case also, a microphone could be connected to the left side input of the amplifier, so that the user can sing along with the prerecorded vocal signal.

In the description set forth above, the right and left sides could be reversed, i.e., connections 35 and 36 connected to terminals 13 and 19, and branch 33 connected to connection 34, with no change in function.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A vocal signal removing device for use between a musical sound reproducing device and an amplifier, the musical sound reproducing device having left side positive and negative output terminals and right side positive and negative output terminals, and the amplifier having left side positive and negative input terminals and right side positive and negative input terminals, the voice signal removing device including:

means for connecting one of the left or right positive output terminals of the reproducing device to the corresponding left or right positive input terminal of the amplifier, means for connecting the other positive output terminal of the reproducing device to the negative input terminal of the amplifier and the same side to which said one positive output terminal is connected, and means for connecting a microphone to the input of the amplifier which does not include said same side negative input terminal.

2. A vocal signal removing device as defined in claim 1 wherein one of the connecting means connects the left positive output terminal of the reproducing device to the left positive input terminal of the amplifier, and the other connecting means connects the right positive output terminal of the reproducing device to the left negative input terminal of the amplifier.

3. A vocal signal removing device as defined in claim 1 wherein one of the connecting means connects the right positive output terminal of the reproducing device to the right positive input terminal of the amplifier, and the other connecting means connects the left positive output terminal of the reproducing device to the right negative input terminal of the amplifier.

4. A vocal signal removing device as defined in claim 1 being devoid of means for connecting the negative output terminals of the reproducing device to the negative input terminals of the amplifier when the positive output terminals of the reproducing device are connected to the positive and negative input terminals of the amplifier as described in claim 1.

5. A vocal signal removing device for use between a musical sound reproducing device and an amplifier, the musical sound reproducing device having left side positive and negative output terminals and right side positive and negative output terminals, and the amplifier having left side positive and negative input terminals and right side positive and negative input terminals, the voice signal removing device including:

means for connecting the left and right positive output terminals of the reproducing device to the left and right positive input terminals of the amplifier, respectively, means for selectively connecting one of the right and left negative output terminals of the reproducing device to the corresponding right or left negative input terminal of the amplifier or disconnecting said connection (a) and connecting one of the right and left positive output terminals of the reproducing device to the negative input terminal of the amplifier which was involved in connection (a), and means for connecting a microphone to the input of the amplifier which was not involved in connection (a) while connection (b) is in effect.

6. A vocal signal removing device as defined in claim 5 wherein the selection means can disconnect connection (a) and connect one of the positive output terminals of the reproducing device to the opposite negative output terminal of the reproducing device.

7. A vocal signal removing device as defined in claim 5 wherein the selective means is a switch.

8. A vocal signal removing device as defined in claim 1 wherein the connecting means consist only of standard coaxial terminal connectors and wires extending between the connectors.

9. A vocal signal removing device as defined in claim 5 wherein the connecting means consist only of standard coaxial terminal connectors, wires extending between the connectors, and a switch.

10. A method of removing the vocal signal from a reproduced musical sound, comprising the steps of:

connecting one of the left or right side positive output terminals of a sound reproducing device to the corresponding left or right side positive input terminal of an amplifier, connecting the other positive output terminal of the reproducing device to the negative input terminal of the amplifier on the same side to which said one positive output terminal is connected, and connecting a microphone to the input of the amplifier which does not include said same side negative input terminal.

* * * * *